US007863339B2

(12) United States Patent
Holt

(10) Patent No.: US 7,863,339 B2
(45) Date of Patent: Jan. 4, 2011

(54) SYNERGISTIC COMBINATION OF DEMULSIFIERS FOR ENHANCING DEMULSIFICATION PROPERTIES IN INDUSTRIAL LUBRICANTS

(75) Inventor: David G. L. Holt, Medford, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 12/799,745

(22) Filed: Apr. 30, 2010

(65) Prior Publication Data

US 2010/0273690 A1 Oct. 28, 2010

Related U.S. Application Data

(62) Division of application No. 11/503,359, filed on Aug. 11, 2006.

(51) Int. Cl.
*B01D 17/05* (2006.01)

(52) U.S. Cl. ..... 516/163; 516/162; 516/181; 516/191

(58) Field of Classification Search ..... 516/162, 516/163, 181, 191
See application file for complete search history.

(56) References Cited

U.S. PATENT DOCUMENTS 6,498,129 B1 * 12/2002 Meny et al. ..... 508/293

* cited by examiner

*Primary Examiner*—Ling-Siu Choi
*Assistant Examiner*—Chun-Cheng Wang

(57) ABSTRACT

A synergistic demulsifier composition for the improvement of demulsification properties and method of making said composition is disclosed along with a lubricant composition containing same. The demulsifier composition consists of effective amounts of one or more demulsifier additives and one or more dispersants. The demulsifier additives consist of a first copolymer of propylene oxide and ethylene oxide and a second copolymer of propylene oxide and ethylene oxide. The dispersant can be an untreated polyalkene succinimide type dispersant, preferably an untreated polyisobutylene succinimide type dispersant.

10 Claims, 1 Drawing Sheet

SYNERGISTIC COMBINATION OF DEMULSIFIERS FOR ENHANCING DEMULSIFICATION PROPERTIES IN INDUSTRIAL LUBRICANTS

This application is a Divisional Under 37 C.F.R §1.53(d) of U.S. Ser. No. 11/503,359 filed Aug. 11, 2006.

FIELD OF THE INVENTION

This invention relates to demulsifier and lubricant compositions. More particularly, this invention relates to a synergistic combination of one or more demulsifiers for improving demulsification properties and minimizing lacquer formation in lubricant systems while in the presence of one or more dispersants. This invention also relates to lubricant compositions containing the synergistic demulsifier composition of the present invention.

BACKGROUND OF THE INVENTION

Lacquer is an insoluble film layer that develops over metal surfaces when metal surfaces are contacted with oil based lubricant compositions. To control lacquer formation, dispersants are added to lubricant mixtures. Lacquer can cause wear of system components and an overall reduction in system performance. Unfortunately, the presence of dispersants in lubricants has the undesirable effect of facilitating the formation of stable water-in-oil emulsions. Water is an undesirable contaminant of lubricant systems as it reduces the effectiveness of lubricants by forming harmful by-products. These water-in-oil emulsions cause losses in system efficiencies because they do not transmit power as effectively as lubricants nor do they lubricate as effectively as needed. There is thus a need to improve the demulsification, i.e., watershedding, properties of oil based lubricants formulated with dispersants. Demulsification is the process by which unwanted water-in-oil emulsions are "broken up."

In the prior art, many demulsifiers have been suggested and used. Demulsifier additives known in the art include but are not limited to derivatives of propylene oxide, ethylene oxide, polyoxyalkylene alcohols, alkyl amines, amino alcohols, diamines or polyamines reacted sequentially with ethylene oxide or substituted ethylene oxides or mixtures thereof. Examples of demulsifier additives include trialkyl phosphates, polyethylene glycols, polyethylene oxides, polypropylene oxides, (ethylene oxide-propylene oxide) polymers and mixtures thereof U.S. Pat. No. 4,129,508 discloses the use of reaction products of a hydrocarbon substituted succinic acid or anhydride with one or more polyalkylene glycols or monoethers thereof to improve demulsification properties of lubricant and fuel compositions. U.S. Pat. No. 4,396,518 discloses an improved demulsification additive that is a combination of an acylated alkoxylated isopentylphenolic resin and a propoxylated-ethyoxylated amylphenolic resin. U.S. Pat. No. 5,753,598 discloses a combination of an epoxy-based demulsifier and a heterocyclic compound to improve water shedding properties in trunk piston oils. U.S. Pat. No. 6,255,263 discloses the use of at least one oil-soluble polyoxypropylene glycol monoalkyl ether to improve demulsification properties. U.S. Pat. No. 6,544,937 discloses a lubricating composition containing naphthenic basestocks having improved demulsification properties by the addition of a demulsification additive selected from oxyalkylated glycols, esters of oxyalkylated glycols and mixtures thereof GB 2,265,149 discloses the use of at least one block copolymer or propylene oxide and ethylene oxide and at least one oxyalkylated amine to improve demulsification properties while not interfering with the effectiveness of rust inhibitors used.

Despite the advances in lubricant oil formulation technology, there remains a need for demulsifiers that effectively reduce the formation of emulsions in oil based lubricants formulated with dispersants added to minimize the formation of lacquer.

SUMMARY OF THE INVENTION

In accordance with a first aspect of the invention, there is provided a synergistic demulsifier composition useful for improving demulsification properties in lubricant compositions while in the presence of a dispersant used to minimize lacquer formation. The synergistic demulsifier composition consists of effective amounts of one or more demulsifier additives and one or more dispersants.

In another aspect of the invention, there is provided a lubricant composition containing the synergistic demulsifier composition of the present invention.

In yet another aspect of the invention, there is provided a method of making a lubricant composition containing the synergistic demulsifier composition of the present invention.

Other objects and advantages of the present invention will become apparent from the detailed description that follows.

DETAILED DESCRIPTION

Figure 1:
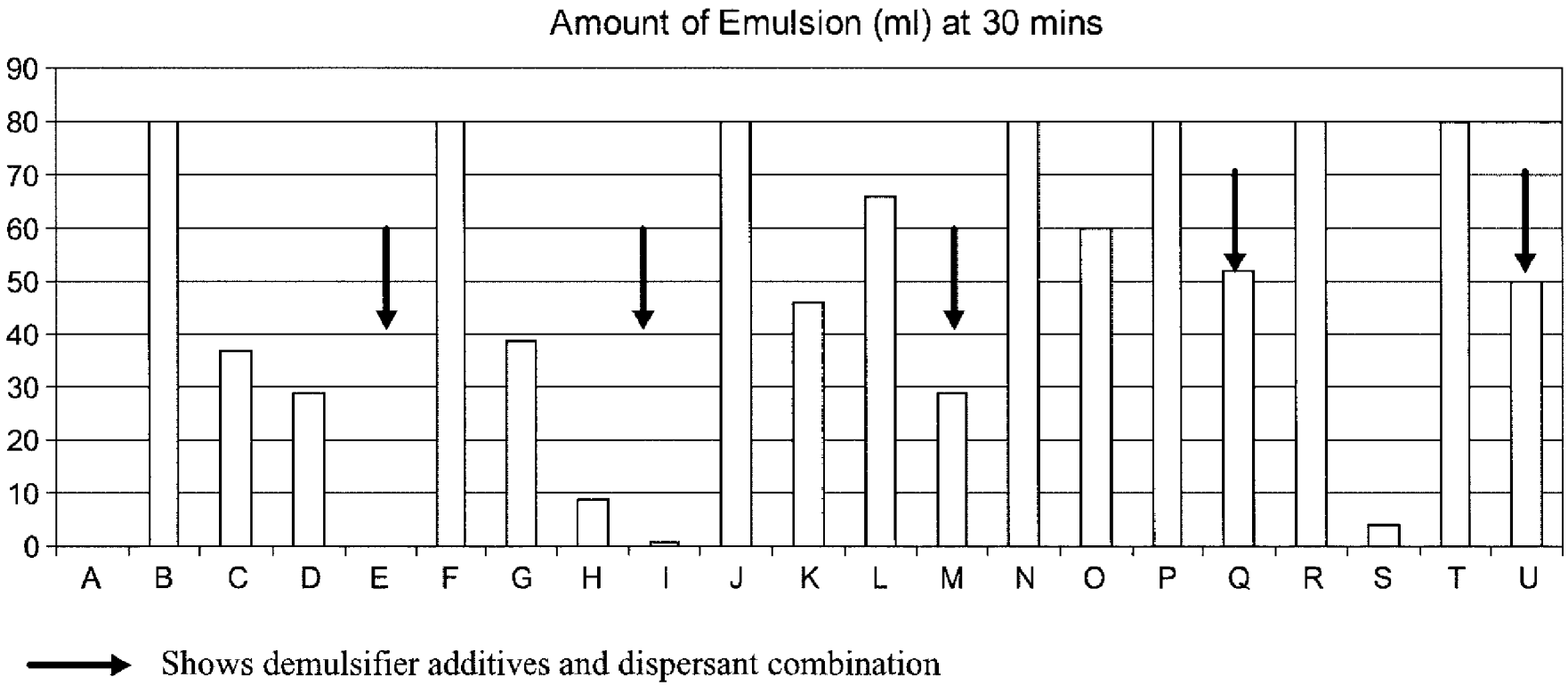
FIG. 1 shows the surprising and unexpected results obtained from using the synergistic demulsifier composition of the present invention.

The demulsifier additives of the present invention may be at least one co-polymer of propylene oxide and ethylene oxide, preferably, the demulsifier additives are a first co-polymer of propylene oxide and ethylene oxide and a second co-polymer of propylene oxide and ethylene oxide. More preferably, the first co-polymer of propylene oxide and ethylene oxide is different than the second co-polymer of propylene oxide and ethylene oxide. The first co-polymer of propylene oxide and ethylene oxide and the second co-polymer of propylene oxide and ethylene oxide may be end capped on a first end or a second end, or both. Preferably, the first co-polymer of propylene oxide and ethylene oxide contains no end caps, more preferably, the first co-polymer of propylene oxide and ethylene oxide contains —OH end groups. Preferably, the second co-polymer of propylene oxide and ethylene oxide contains methyl carbonate end caps, more preferably, the second co-polymer of propylene oxide and ethylene oxide contains methyl carbonate and methyl ether end caps. Suitable co-polymers of propylene oxide and ethylene oxide typically have molecular weights from about 5,000 to about 10,000, preferably from about 6,000 to about 8,000. Generally, the weight ratio of propylene oxide to ethylene oxide in the first co-polymer of propylene oxide and ethylene oxide and in the second co-polymer of propylene oxide and ethylene oxide is about 1:1 to about 3:1, preferably from about 1.5:1 to about 2:1. Typically, the weight ratio of the first co-polymer of propylene oxide and ethylene oxide to the second co-polymer of propylene oxide and ethylene oxide used in the present invention is about 1:2, preferably about 1:1.

The demulsifier additives of the present invention are used in an effective amount. By effective amount, it is meant that the demulsifier additives are present in an amount from about 0.001 to about 0.05 wt % of the total weight of the composition and preferably from about 0.005 to about 0.03 wt %. Higher amounts can be added, but it is believed that amounts greater than 0.05 wt % can lead to detrimental performance.

During operations, oil-insoluble oxidation byproducts, such as lacquer, are produced. Dispersants help keep these byproducts in solution, thus diminishing their deposition on metal surfaces. Dispersants used may be ashless or ash-forming in nature. Preferably, the dispersant is ashless.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

A particularly useful class of dispersants are the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; and 5,705,458.

Hydrocarbyl-substituted succinic acid compounds are popular dispersants. In particular, succinate esters, succinate ester amides or succinimides are particularly useful. Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197.

Succinate esters are formed by the condensation reaction between to alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpoly-amines and polyalkenylpolyamines such as polyethylene polyamines. One example is propoxylated hexamethylenediamine. Representative examples are shown in U.S. Pat. No. 4,426,305.

Succinimides are formed by the condensation reaction between alkenyl succinic anhydrides and amines. Molar ratios can vary depending on the polyamine. For example, the molar ratio of alkenyl succinic anhydride to tetraethylenepentamine (TEPA) can vary from about 1:1 to about 5:1. Representative examples are shown in U.S. Pat. Nos. 3,087,936; 3,172,892; 3,219,666; 3,272,746; 3,322,670; 3,652,616; and 3,948,800.

Preferred dispersants include untreated succinimides, including those derivatives from mono-succinimides, bis-succinimides, and/or mixtures of mono- and bis-succinimides. The term "untreated" refers to a succinimide that has not been treated with a boron or zinc compound under reactive conditions. Substituted succinimides include polyalkene succinimides where the polyalkene is characterized by a number average molecular weight (Mn) of from about 1,300 to about 5,000. Examples of polyalkenes include polypropylenes, polybutylenes, ethylene-propylene copolymers, styrene-isobutene copolymers, isobutene-butadiene-1,3 copolymers, propene-isoprene copolymers, isobutene-chloroprene copolymers, isobutene-(para-methyl)styrene copolymers, copolymers of hexene-1 with hexadiene-1,3, copolymers of octene-1 with hexene-1, copolymers of heptene-1 with pentene-1, copolymers of 3-methyl-butene-1 with octene-1, copolymers of 3,3-dimethyl-pentene-1 with hexene-1, and terpolymers of isobutene, styrene and piperylene. See U.S. Pat. No. 4,234,435. More preferred dispersants are untreated polyalkene succinimide type dispersants. Most preferred are untreated polyisobutylene succinimide type dispersants. Other preferred dispersants include untreated succinic amides and other related components. Such dispersants are used in an effective amount. By effective amount, it is meant that the dispersant is present in an amount from about 0.01 to 0.5 wt %, preferably about 0.1 to 0.3 wt %, of the total weight of the composition.

The molecular weight of the dispersants of the present invention will typically range between about 1,000 and about 3,000. The weight ratio of the combined demulsifier additives to dispersants in the present invention is about 1:15, preferably about 1:10.

A wide range of lubricating base oils is known in the art. Lubricating base oils that are useful in the present invention are both natural oils, synthetic oils, and unconventional oils, natural oils, and synthetic oils, and unconventional oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used.

Groups I, II, III, IV and V are broad categories of base oil stocks developed and defined by the American Petroleum Institute (API Publication 1509; www.API.org) to create guidelines for lubricant base oils. Group I base stocks generally have a viscosity index of between about 80 to 120 and contain greater than about 0.03% sulfur and/or less than about 90% saturates. Group II base stocks generally have a viscosity index of between about 80 to 120, and contain less than or equal to about 0.03% sulfur and greater than or equal to about 90% saturates. Group III stocks generally have a viscosity index greater than about 120 and contain less than or equal to about 0.03% sulfur and greater than about 90% saturates. Group IV includes polyalphaolefins (PAO). Group V base stock includes base stocks not included in Groups I-IV. The table below summarizes properties of each of these five groups.

Base Oil Properties

| | Saturates | Sulfur | Viscosity Index |
|---|---|---|---|
| Group I | <90 &/or | >0.03% & | ≧80 & <120 |
| Group II | ≧90 & | ≦0.03% & | ≧80 & <120 |
| Group III | ≧90 & | ≦0.03% & | ≧120 |
| Group IV | Includes polyalphaolefins (PAO) and Gas-to-Liquids (GTL) products | | |
| Group V | All other base oil stocks not included in Groups I, II, III, or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Group II and/or Group III hydroprocessed or hydrocracked is basestocks, including synthetic oils such as polyalphaolefins, alkyl aromatics and synthetic esters are also well known basestock oils.

Synthetic oils include hydrocarbon oil. Hydrocarbon oils include oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks are a commonly used synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073.

The number average molecular weights of the PAOs, which are known materials and generally available on a major commercial scale from suppliers such as ExxonMobil Chemical Company, Chevron Phillips Chemical Company, BP, and others, typically vary from about 250 to about 3,000, although PAO's may be made in viscosities up to about 100 cSt (100° C.). The PAOs are typically comprised of relatively low molecular weight hydrogenated polymers or oligomers of alphaolefins which include, but are not limited to, $C_2$ to about $C_{32}$ alphaolefins with the $C_8$ to about $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins. However, the dimers of higher olefins in the range of $C_{14}$ to $C_{18}$ may be used to provide low viscosity basestocks of acceptably low volatility. Depending on the viscosity grade and the starting oligomer, the PAOs may be predominantly trimers and tetramers of the starting olefins, with minor amounts of the higher oligomers, having a viscosity range of 1.5 to 12 cSt.

The PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or U.S. Pat. No. 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

The hydrocarbyl aromatics can be used as base oil or base oil component and can be any hydrocarbyl molecule that contains at least about 5% of its weight derived from an aromatic moiety such as a benzenoid moiety or naphthenoid moiety, or their derivatives. These hydrocarbyl aromatics include alkyl benzenes, alkyl naphthalenes, alkyl diphenyl oxides, alkyl naphthols, alkyl diphenyl sulfides, alkylated bis-phenol A, alkylated thiodiphenol, and the like. The aromatic can be mono-alkylated, dialkylated, polyalkylated, and the like. The aromatic can be mono- or poly-functionalized. The hydrocarbyl groups can also be comprised of mixtures of alkyl groups, alkenyl groups, alkynyl, cycloalkyl groups, cycloalkenyl groups and other related hydrocarbyl groups. The hydrocarbyl groups can range from about $C_6$ up to about $C_{60}$ with a range of is about $C_8$ to about $C_{20}$ often being preferred. A mixture of hydrocarbyl groups is often preferred, and up to about three such substituents may be present. The hydrocarbyl group can optionally contain sulfur, oxygen, and/or nitrogen containing substituents. The aromatic group can also be derived from natural (petroleum) sources, provided at least about 5% of the molecule is comprised of an above-type aromatic moiety. Viscosities at 100° C. of approximately 3 cSt to about 50 cSt are preferred, with viscosities of approximately 3.4 cSt to about 20 cSt often being more preferred for the hydrocarbyl aromatic component. In one embodiment, an alkyl naphthalene where the alkyl group is primarily comprised of 1-hexadecene is used. Other alkylates of aromatics can be advantageously used. Naphthalene or methyl naphthalene, for example, can be alkylated with olefins such as octene, decene, dodecene, tetradecene or higher, mixtures of similar olefins, and the like. Useful concentrations of hydrocarbyl aromatic in a lubricant oil composition can be about 2% to about 25%, preferably about 4% to about 20%, and more preferably about 4% to about 15%, depending on the application.

Alkylated aromatics may be produced by well-known processes. See Friedel-Crafts and Related Reactions, Olah, G.A. (ed), Interscience Publishers, New York, 1963, ACS Petroleum Chemistry Preprint 1053-1058, "Poly n alkylbenzene Compounds: A Class of Thermally Stable and Wide Liquid Range Fluids", Eapen et al, Phila., 1984. See also U.S. Pat. No. 5,055,626, EP 168 534A, U.S. Pat. No. 4,658,072. For example, an aromatic compound, such as benzene or naphthalene, is alkylated by an olefin, alkyl halide or alcohol in the presence of a Friedel-Crafts catalyst. See Friedel-Crafts and Related Reactions, Vol. 2, part 1, chapters 14, 17, and 18, See Olah, G.A. (ed), Interscience Publishers, New York, 1964. Many homogeneous or heterogeneous solid catalysts are known to one skilled in the art. The choice of catalyst depends on the reactivity of the starting materials and product quality requirements. For example, strong acids such as $AlCl_3$, $BF_3$, or HF may be used. In some cases, milder catalysts such as $FeCl_3$ or $SnCl_4$ are preferred. Other alkylation technology uses zeolites such as ultra stable zeolite Y or solid super acids.

Alkylbenzenes are used as lubricant basestocks, especially for low-temperature applications (arctic vehicle service and refrigeration oils) and in papermaking oils. They are commercially available from producers of linear alkylbenzenes (LABs) such as Vista Chemical Co, Huntsman Chemical Co., Chevron Chemical Co., and Nippon Oil Co. The linear alkylbenzenes typically have good low pour points and low temperature viscosities and VI values greater than 100 together with good solvency for additives. Other alkylated aromatics which may be used when desirable are described, for example, in "Synthetic Lubricants and High Performance Functional Fluids", Dressler, H., chap 5, (R. L. Shubkin (Ed.)), Marcel Dekker, N.Y. 1993.

Esters comprise a useful base stock. Additive solvency and seal compatibility characteristics may be secured by the use of esters such as the esters of dibasic acids with monoalkanols and the polyol esters of mono-carboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols (such as the neopentyl polyols, e.g., neopentyl glycol, trimethylol ethane, 2-methyl-2-propyl-1,3-propanediol, trimethylol propane, pentaerythritol and dipentaerythritol) with alkanoic acids containing at least about 4 carbon atoms, prefer-ably $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid, or mixtures of any of these materials.

Suitable synthetic ester components include the esters of trimethylol propane, trimethylol butane, trimethylol ethane, pentaerythritol and/or dipentaerythritol with one or more monocarboxylic acids containing from about 5 to about 10 carbon atoms. These esters are widely available commercially, for example, the Mobil P-41 and P-51 esters of ExxonMobil Chemical Company).

Desirable esters include pentaerythritol esters, derived from mono-, di-, and poly pentaerythritol polyols reacted with mixed hydrocarbyl acids ($RCO_2H$), and where a substantial amount of the available —OH groups are converted to esters. The substituent hydrocarbyl groups, R, of the acid moiety and ester comprise from about $C_6$ to about $C_{16}$ or more, with preferable ranges being about $C_6$ to about $C_{14}$, and may comprise alkyl, alkenyl, cycloalkyl, cycloalkenyl, linear, branched, and related hydrocarbyl groups, and can optionally contain S, N, and/or O groups. Pentaerythritol esters with mixtures of substituent hydrocarbyl groups, R, are often preferred. For example, substituent hydrocarbyl groups, R, may comprise a substantial amount of $C_8$ and $C_{10}$ hydrocarbyl moieties in the proportions of about 1:4 to 4:1. In a mode, a preferred pentaerythritol ester has R groups comprising approximately about 55% $C_8$, about 40% $C_{10}$, and the remainder approximately 5% $C_6$ and $C_{12+}$ moieties. For example, one useful pentaerythritol ester has a viscosity index of about 148, a pour point of about 3° C. and a kinematic viscosity of about 5.9 cSt at 100° C. The pentaerythritol esters can be used in lubricant compositions at concentrations of about 3% to about 30%, preferably about 4% to about 20%, and more preferably about 5% to about 15%.

Other useful fluids of lubricating viscosity include non-conventional or unconventional base stocks that have been processed, preferably catalytically, or synthesized to provide high performance lubrication characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

The base oil constitutes the major component of the lubricating oil compositions of the present invention and typically is present in an amount ranging from about 50 to about 99 wt. %, e.g., from about 85 to about 95 wt. %, based on the total weight of the composition. The base oil may be selected from any of the synthetic or natural oils typically used as crankcase lubricating oils for spark-ignited and compression-ignited engines. The base oil conveniently has a kinematic viscosity, according to ASTM standards, of about 2.5 cSt to about 12 cSt (or $mm^2/s$) at 100° C. and preferably of about 2.5 cSt to about 9 cSt (or $mm^2/s$) at 100° C. Mixtures of synthetic and natural base oils may be used if desired.

The lubricant compositions of the present invention may include other additives such as extreme pressure agents, metal deactivators, antioxidants, rust inhibitors, pour point depressants, antifoamants, etc.

Among suitable extreme pressure agents are olefin polysulfides and phosphate esters. Hindered phenols and alkylated diphenyl amines are especially useful antioxidants. Benzotriazole derivatives are useful in the lubricant composition as a metal passivator. Alkyl succinimides may be used as antitrust additives. Suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. The antifoamant used typically will be a silicone oil antifoamant.

The foregoing additives are all commercially available materials. Indeed, these additives are usually not added independently but are precombined in packages which can be obtained from suppliers of lubricant oil additives. Additive packages with a variety of ingredients, proportions and characteristics are available and selection of the appropriate package will take the requisite use of the ultimate composition into account.

In preparing the lubricant compositions of the present invention, the synergistic demulsifier composition of the present invention and other additives are mixed with a base oil stock to make up a substantially homogeneous mixture. The compounds are mixed at a blending temperature from about 25° C. to about 75° C., preferably about 50° C.

The following non-limiting examples are provided to illustrate the invention.

Example 1

A series of lubricant compositions were formulated and evaluated for their ability to demulsify water.

Group I 150N is a base stock oil having a kinematic viscosity at 40° C. of 30 cSt and a Viscosity Index of 95 according to ASTM standards D445 and D2270, respectively. Group I 600N is a base stock oil having a kinematic viscosity at 40° C. of 112 cSt and a Viscosity Index of 95 according to ASTM standards D445 and D2270, respectively.

The untreated polyisobutylene succinimide type dispersant has a molecular weight ranging between about 1,000 and about 3,000.

The first co-polymer of propylene oxide and ethylene oxide contains —OH end groups. The amount of first co-polymer used is given on an as received basis. The concentration of the first co-polymer in the mixture received from the manufacturer is approximately 44 wt. %. The second co-polymer of propylene oxide and ethylene oxide contains methyl carbonate and methyl ether end caps. The amount of second co-polymer used is given on an as received basis. The concentration of the second co-polymer in the mixture received from the manufacturer is approximately 38 wt. %. The first and second co-polymers of propylene oxide and ethylene oxide have molecular weights ranging from about 6,000 to about 8,000.

The pour point depressant is a polymethacrylate.

All formulations were evaluated using ASTM test method D1401, which measures the ability of petroleum oils or synthetic fluids to separate from water. A 40 mL sample of each lubricant composition formulated as shown in Table 1 and a 40 mL sample of water were stirred for 5 minutes at a temperature of 54° C. The time required for the resulting emulsion to separate was recorded after every 5 minutes until 30 minutes had elapsed. The compositions and results are given in Table 1.

TABLE 1

| | A | B | C | D | E |
|---|---|---|---|---|---|
| Group I 150N, wt. % | 35.00 | 35.00 | 35.00 | 35.00 | 35.00 |
| Group I 600N, wt. % | 64.90 | 64.70 | 64.68 | 64.68 | 64.68 |
| Untreated polyisobutylene succinimide type dispersant, wt. % | | 0.20 | 0.20 | 0.20 | 0.20 |
| A first co-polymer of propylene oxide and ethylene oxide, wt. % | | | 0.02 | | 0.01 |
| A second co-polymer of propylene oxide and ethylene oxide, wt. % | | | | 0.02 | 0.01 |
| Pour Pt. Depressant, wt. % | 0.10 | 0.10 | 0.10 | 0.10 | 0.10 |
| KV (cSt) at 40° C. according to ASTM D445 | 68.76 | 69.27 | 69.14 | 70.26 | 68.88 |
| Oil/Water/Emulsion (mL)(Time, min.) | 42/38/0 (10) | 0/0/80 (30) | 38/5/37 (30) | 30/21/29 (30) | 42/38/0 (25) |

Several trials were conducted to show the effects of having no demulsifer additives present, only one demulsifier additive present and a combination of demulsifier additives present. The results are presented as mL of oil/mL of water/mL of emulsion (time).

The trial labeled A contained no demulsifier additives and no dispersant. The effects of not having either present are shown as 42/38/0 (10). This means that 42 mL of oil, 38 mL of water and 0 mL of emulsion were present after 10 minutes had elapsed. In the trial labeled B, a dispersant is added to the mixture and after 30 minutes, the sample was completely in an emulsified state establishing the adverse effect of the dispersant on demulsification. Both trials labeled C and D, contained one demulsifier additive in the mixture. As can be seen, using only one demulsifier additive in the mixture did not completely demulsify the mixture: Trial C resulted in 38 mL of oil, 5 mL of water and 37 mL of emulsion after 30 minutes and Trial D resulted in 30 mL of oil, 21 mL of water and 29 mL of emulsion after the same amount of time. Surprisingly, trial E, which contained a dispersant and both demulsifier additives in the mixture, to resulted in complete demulsification of the mixture after only 25 minutes establishing that the mixture can be completely demulsified while still effecting lacquer formation control through the use of the dispersant. The unexpected results were even more surprising considering that the dosing of the mixture with demulsifier additive stayed the same, a total of 0.02 wt. % of demulsifier was used. The use of this synergistic combination resulted in 42 mL of oil, 38 mL of water and 0 mL of emulsion after 25 minutes.

As illustrated in the foregoing trials, it can be seen that the detrimental effects to demulsification from adding a dispersant to a lubricant composition to control lacquer formation were overcome by the addition of the synergistic demulsifier composition.

Example 2

Another series of lubricant compositions were formulated and evaluated for their ability to demulsify oil and water, according to the procedure of Example 1. The formulations and results of this evaluation are provided in Table 2. The dispersant used is an untreated polyisobutylene succinimide type dispersant having a molecular weight ranging between about 1,000 and about 3,000. All other ingredients and test methods were identical to those used in the formulations of Table 1.

TABLE 2

| | F | G | H | I |
|---|---|---|---|---|
| Group I 150N, wt. % | 35.00 | 35.00 | 35.00 | 35.00 |
| Group I 600N, wt. % | 64.70 | 64.68 | 64.68 | 64.68 |
| Untreated polyisobutylene succinimide type dispersant, wt. % | 0.20 | 0.20 | 0.20 | 0.20 |
| A first co-polymer of propylene oxide and ethylene oxide, wt. % | | 0.02 | | 0.01 |
| A second co-polymer of propylene oxide and ethylene oxide, wt. % | | | 0.02 | 0.01 |
| Pour Pt. Depressant, wt. % | 0.10 | 0.10 | 0.10 | 0.10 |
| KV at 40° C. according to ASTM D445 | 69.44 | 69.32 | 69.33 | 69.32 |
| Oil/Water/Emulsion (mL) (Time, min.) | 0/0/80 (30) | 29/36/15 (30) | 41/30/9 (30) | 41/38/1 (30) |

As shown in Table 2, the demulsification unexpectedly improved when using the dispersant in combination with the two demulsifier additives. The use of this synergistic combination of demulsifier additives in the presence of the dispersant resulted in 41 mL of oil, 38 mL of water and 1 mL of emulsion after 30 minutes as exemplified in Trial I.

Example 3

Another series of lubricant compositions were formulated and evaluated for their ability to demulsify oil and water according to the procedure of Example 1. In this example, the dispersant used is a zinc blocked succinimide type dispersant. The formulations and results of this evaluation are provided in Table 3.

TABLE 3

| | J | K | L | M |
|---|---|---|---|---|
| Group I 150N, wt. % | 35.00 | 35.00 | 35.00 | 35.00 |
| Group I 600N, wt. % | 64.70 | 64.68 | 64.68 | 64.68 |
| Zinc-blocked succinimide type dispersant, wt. % | 0.20 | 0.20 | 0.20 | 0.20 |
| A first co-polymer of propylene oxide and ethylene oxide, wt. % | | 0.02 | | 0.01 |
| A second co-polymer of propylene oxide and ethylene oxide, wt. % | | | 0.02 | 0.01 |
| Pour Pt. Depressant, wt. % | 0.10 | 0.10 | 0.10 | 0.10 |
| KV at 40° C. according to ASTM D445 | 69.18 | 69.11 | 69.19 | 69.25 |
| Oil/Water/Emulsion (mL) (Time, min.) | 0/0/80 (30) | 29/5/46 (30) | 0/14/66 (30) | 35/18/27 (30) |

Not all combinations of dispersants and demulsifier additives function as surprisingly as those disclosed in Table 1 and 2. As can be seen in Trial M, the resulting mixture was not completely demulsified. After 30 minutes, only 35 mL of oil and 18 mL of water were separated out leaving 27 mL of the mixture in an emulsive state.

Example 4

A series of lubricant compositions were formulated and evaluated for their ability to demulsify oil and water according to the procedure of Example 1. In this example, the dispersant used is a nitrogen-containing Mannich type dispersant. Mannich dispersants are made from the reaction of alkylphenols, formaldehyde and amines. See U.S. Pat. No. 4,767,551. Process aids and catalysts, such as oleic acid and sulfonic acids, can also be part of the reaction mixture.

Example 5

Similarly, a series of lubricant compositions were formulated and evaluated for their ability to demulsify oil and water according to the procedure of Example 1. The dispersant used is a borated succinimide type dispersant.

As illustrated in both Tables 4 and 5, the resulting mixtures were not completely demulsified after the specified time had elapsed.

TABLE 4

| | N | O | P | Q |
|---|---|---|---|---|
| Group I 150N, wt. % | 35.00 | 35.00 | 35.00 | 35.00 |
| Group I 600N, wt. % | 64.70 | 64.68 | 64.68 | 64.68 |
| Nitrogen-containing Mannich dispersant, wt. % | 0.20 | 0.20 | 0.20 | 0.20 |
| A first co-polymer of propylene oxide and ethylene oxide, wt. % | | 0.02 | | 0.01 |
| A second co-polymer of propylene oxide and ethylene oxide, wt. % | | | 0.02 | 0.01 |
| Pour Pt. Depressant, wt. % | 0.10 | 0.10 | 0.10 | 0.10 |
| KV at 40° C. according to ASTM D445 | 69.52 | 69.47 | 69.49 | 69.50 |
| Oil/Water/Emulsion (mL) (Time, min.) | 0/0/80 (30) | 0/20/60 (30) | 0/0/80 (30) | 3/25/52 (30) |

TABLE 5

| | R | S | T | U |
|---|---|---|---|---|
| Group I 150N, wt. % | 35.00 | 35.00 | 35.00 | 35.00 |
| Group I 600N, wt. % | 64.70 | 64.68 | 64.68 | 64.68 |
| Borated succinimide type dispersant, wt. % | 0.20 | 0.20 | 0.20 | 0.20 |
| A first co-polymer of propylene oxide and ethylene oxide, wt. % | | 0.02 | | 0.01 |
| A second co-polymer of propylene oxide and ethylene oxide, wt. % | | | 0.02 | 0.01 |
| Pour Pt. Depressant, wt. % | 0.10 | 0.10 | 0.10 | 0.10 |
| KV at 40° C. according to ASTM D445 | 69.69 | 69.17 | 69.37 | 69.41 |
| Oil/Water/Emulsion (mL) (Time, min.) | 0/0/80 (30) | 40/36/4 (30) | 0/0/80 (30) | 5/25/50 (30) |

The results of Tables 1-5 have been charted in FIG. 1 to better demonstrate the surprising and unexpected results obtained from using the synergistic demulsifier composition of the present invention.

It will thus be seen that the objects set forth above, among those apparent in the preceding description, are efficiently attained and, since certain changes may be made in carrying out the present invention without departing from the spirit and scope of the invention, it is intended that all matter contained in the above description and shown in the accompanying drawing be interpreted as illustrative and not in a limiting sense.

It is also understood that the following claims are intended to cover all of the generic and specific features of the invention herein described and all statements of the scope of the invention, which as a matter of language, might be said to fall therebetween.

What is claimed is:

1. A lubricating composition comprising a base stock oil and a synergistic demulsifier composition consisting of:

effective amounts of demulsifier additives, wherein said demulsifier additives consist of a first copolymer of propylene oxide and ethylene oxide and a second copolymer of propylene oxide and ethylene oxide, said second copolymer of propylene oxide and ethylene oxide is different than said first copolymer of propylene oxide and ethylene oxide and contains methyl carbonate end caps; and a dispersant, wherein said dispersant is an untreated polyalkene succinimide dispersant.

2. The lubricating composition of claim 1, wherein said base stock oil comprises about 50 wt. % to about 99 wt. % of the composition.

3. The lubricating composition of claim 1, wherein said first copolymer of propylene oxide and ethylene oxide comprises about 0.001 wt. % to about 0.05 wt. % of the composition.

4. The lubricating composition of claim 1, wherein said second copolymer of propylene oxide and ethylene oxide comprises about 0.001 wt. % to about 0.05 wt. % of the composition.

5. The lubricating composition of claim 1, wherein said dispersant comprises from about 0.01 wt. % to about 0.5 wt. % of the composition.

6. The lubricating composition of claim 1, wherein said first copolymer of propylene oxide and ethylene oxide and said second copolymer of propylene oxide and ethylene oxide each have a molecular weight from about 5,000 to about 10,000.

7. The lubricating composition of claim 1, wherein said dispersant has a molecular weight from about 1,000 to about 3,000.

8. The lubricating composition of claim 1, wherein said first copolymer of propylene oxide and ethylene oxide is present in a weight ratio of propylene oxide:ethylene oxide from about 1:1 to about 3:1.

9. The lubricating composition of claim 1, wherein said second copolymer of propylene oxide and ethylene oxide is present in a weight ratio of propylene oxide:ethylene oxide from about 1:1 to about 3:1.

10. A method for improving demulsification properties of a lubricant composition comprising adding a synergistic demulsifier composition consisting of effective amounts of demulsifier additives, wherein said demulsifier additives consist of a first copolymer of propylene oxide and ethylene oxide and a second copolymer of propylene oxide and ethylene oxide, said second copolymer of propylene oxide and ethylene oxide is different than said first copolymer of propylene oxide and ethylene oxide and contains methyl carbonate end caps; and a dispersant, wherein said dispersant is an untreated polyalkene succinimide dispersant, to a base stock oil.

* * * * *